US005899447A

United States Patent [19]

Muckenfuhs

[11] Patent Number: 5,899,447

[45] Date of Patent: May 4, 1999

[54] APPARATUS FOR STACKING POP-UP TOWELS

[75] Inventor: Delmar Ray Muckenfuhs, Middletown, Ohio

[73] Assignee: The Procter & Gamble Company, Cincinnati, Ohio

[21] Appl. No.: 08/922,721

[22] Filed: Sep. 2, 1997

[51] Int. Cl.[6] ..... B41L 1/32; B31B 1/16

[52] U.S. Cl. ..... 270/39.06; 270/32; 493/357; 493/365; 493/416

[58] Field of Search ..... 270/32, 39.01, 270/39.05, 39.06, 39.07, 39.08, 39.09; 493/411, 413, 416, 417, 418, 422, 362, 433, 436, 356, 357, 359, 360, 364, 365, 450

[56] References Cited

U.S. PATENT DOCUMENTS

| | | | |
|---|---|---|---|
| 1,964,700 | 6/1934 | Winter et al. | 493/433 X |
| 2,449,663 | 9/1948 | Marcalus | 270/39.07 |
| 2,553,054 | 5/1951 | Lincoln et al. | 493/464 |
| 3,000,250 | 9/1961 | Altmann et al. | 83/341 |
| 3,034,780 | 5/1962 | Stelling, Jr. et al. | 270/39 |
| 3,230,809 | 1/1966 | Liick | 83/341 |
| 3,473,449 | 10/1969 | Thousand | 493/442 X |
| 3,787,041 | 1/1974 | Hertrich | 493/432 X |
| 3,980,289 | 9/1976 | Harm | 270/40 |
| 4,058,202 | 11/1977 | Reist et al. | 198/482 |
| 4,163,548 | 8/1979 | Nystrand | 270/39 |
| 4,200,017 | 4/1980 | Fein | 83/333 |
| 4,203,584 | 5/1980 | Smaw | 270/40 |
| 4,408,754 | 10/1983 | Meier | 270/52 |
| 4,408,755 | 10/1983 | Meier | 270/52 |
| 4,494,741 | 1/1985 | Fischer et al. | 270/39 |
| 4,501,418 | 2/1985 | Ariga et al. | 271/187 |
| 4,573,670 | 3/1986 | Felix | 270/39 |
| 4,586,703 | 5/1986 | McAnelly | 270/39 |
| 4,664,006 | 5/1987 | Mitchell | 83/341 |
| 4,765,604 | 8/1988 | Trogan | 270/39 |
| 4,770,402 | 9/1988 | Couturier | 270/39 |
| 4,778,441 | 10/1988 | Couturier | 493/425 |
| 4,798,575 | 1/1989 | Siversson | 493/346 |
| 4,799,660 | 1/1989 | Pfizenmaier | 493/362 X |
| 4,824,426 | 4/1989 | DuFresne | 270/39 X |
| 4,917,365 | 4/1990 | Stemmler et al. | 270/52.5 |
| 4,917,665 | 4/1990 | Couturier | 493/472 |
| 4,928,944 | 5/1990 | Golicz | 271/6 |
| 4,943,341 | 7/1990 | Mattei | 156/517 |
| 4,976,677 | 12/1990 | Siversson | 493/413 |

(List continued on next page.)

*Primary Examiner*—William E. Terrell
*Assistant Examiner*—Patrick Mackey
*Attorney, Agent, or Firm*—Roddy M. Bullock; William Scott Andes; Jacobus C. Rasser

[57] ABSTRACT

An apparatus for forming a stack of interleaved, partially overlapping discrete sheets suitable for a pop-up dispenser. The apparatus comprises: a first cutter for cutting a plurality of first discrete sheets; a second cutter for cutting a plurality of second discrete sheets, each second discrete sheet being a mirror image of each first discrete sheet; a rotating vacuum transfer drum having an air impermeable surface rotating with a tangential velocity in operative relationship with the first and second cutters such that the first and second discrete sheets are deposited on the vacuum transfer drum in an alternating spaced relationship after cutting; a vacuum conveyor in operative relationship to receive the first and second discrete sheets from the vacuum transfer drum, the vacuum conveyor moving at a linear velocity less than the tangential velocity of the transfer drum, such that the first and second discrete sheets are transferred from the transfer drum to the vacuum conveyor in a shingled web relationship; an out of planed folder in operative relationship to receive the shingled web from the vacuum conveyor, such that as the vacuum conveyor moves the shingled web linearly, the shingled web is continuously removed from the conveyor and partially folded by the out of plane folder; and an accumulator platform in operative relationship with the out of plane folder, the accumulator platform removing the discrete sheets in a folded and stacked block of interleaved, partially overlapping sheets.

8 Claims, 6 Drawing Sheets

U.S. PATENT DOCUMENTS

| | | | |
|---|---|---|---|
| 5,005,816 | 4/1991 | Stemmler et al. | 270/39 |
| 5,049,123 | 9/1991 | Breton et al. | 493/423 X |
| 5,067,698 | 11/1991 | Stemmler | 270/39 |
| 5,088,707 | 2/1992 | Stemmler | 270/39 |
| 5,094,437 | 3/1992 | Hauschild | 270/39 |
| 5,100,371 | 3/1992 | Helm et al. | 493/229 |
| 5,120,296 | 6/1992 | Yamaguchi et al. | 493/352 |
| 5,147,273 | 9/1992 | Rottmann et al. | 493/349 |
| 5,310,398 | 5/1994 | Yoneyama | 493/430 |
| 5,332,118 | 7/1994 | Muckenfuhs | 221/48 |

APPARATUS FOR STACKING POP-UP TOWELS

FIELD OF THE INVENTION

This invention relates to an improved arrangement of discrete sheets, such as towels or wipes, for use in a pop-up dispensing system. In particular, this invention relates to an improved method and apparatus for forming discrete sheets into an interleaved block of sheets suitable for use in a pop-up dispensing system.

BACKGROUND OF THE INVENTION

Disposable towels, towlettes, and similar sheet products, sometimes referred to as "wipes", have become an increasingly important part of providing for cleanliness in today's society. Whether at home or away from home, traditional cleansing tools such as soap, cloths, and running water may be unavailable, unsuitable, or inconvenient for a particular task. For example, the cleansing of children and infants presents special considerations due to the nature and frequency of the cleansing activity. Often, the use of special agents such as disinfectants an/or moisturizing agents may also be required.

To address these problems, manufacturers of consumer products have developed single-use disposable, synthetic and/or natural fiber-based towel products which are pre-moistened with a nonirritating cleansing agent. As used herein, the terms "single-use" and "disposable" are used interchangeably to refer to towels and packages which are to be used once and then discarded. The terms "moisture", "moistened", and "moistening agent" are intended to refer not only to water or aqueous solutions, but also to any other fluid which may be useful in combination with a towel product. Such fluids may include disinfecting solutions, water-based solutions, oil-based solutions, soaps, lotions, solvents, etc., alone or in combination with dry additives such as powders or granules.

Single-use disposable towel products may be dispensed from a continuous perforated roll, or as discrete towels in a stacked folded arrangement. Stacked and folded towels are preferably interleaved for ease of dispensing. In a folded and interleaved stacked arrangement, discrete towels are interfolded such that they have overlapping edge portions which are substantially parallel to one another, and adhere to one another such that successive towels are fed out through the top of the container, often through an opening sized and configured to hold a leading portion of a towel in an isolated orientation where it can be readily grasped by the user. This method of dispensing is commonly used in multi-sheet containers of dry tissues, such as facial tissues. However, unlike dry sheets, pre-moistened sheets tend to have much higher separation forces; therefore, there is a very narrow range of design parameters such as level of moistness and level of overlap that must be met so as not to cause either the tearing of the topmost towel or the extraction of multiple towels before any separation occurs.

The narrow range of design parameters inherent in interfolded and interleaved pre-moistened towels having overlapping edge portions which are substantially parallel to one another is overcome to a large degree by modifying the geometry of the leading and trailing edges of the sheets. One very acceptable design is disclosed in U.S. Pat. No. 5,332,118, issued Jul. 26, 1994 to Muckenfuhs, which is hereby incorporated herein by reference. The Muckenfuhs towel design utilizes discrete towel sheets in combination with a modified Z-fold stack configuration, the sheets having an overall shape such that the interleaved end edges of adjacent sheets are at least partially non-parallel such that they form an overlapping region having a non-uniform width. This configuration provides improved pop-up dispensing reliability by providing a predictable, repeatable separation process with towel sheets which are pre-moistened or otherwise have an affinity (clinging tendency) toward one another.

The Muckenfuhs towel design, in addition to having an overlapping region having a non-uniform width, may have a region of "underlapping" where there is no overlap of adjacent towels. Consequently, since the amount of overlap at any given point across the sheets determines the shear force required for separation, separation will first occur where the overlap is a minimum and proceed across the overlapping region as a "separation front" moving toward the point of greatest overlap. The separation thus occurs in a predictable fashion, allowing the separation properties of any particular dispensing system to be designed according to a particular application.

The minimal separation forces required to separate adjacent sheets at the point of minimum overlap create special considerations in processing discrete sheets to form a Z-fold stack configuration of wipes suitable for dispensing from a pop-up dispenser. The primary consideration is how to keep positive control and support of the discrete sheets throughout the entire folding, interleaving, and stacking process, thereby maintaining proper sheet-to-sheet positioning. Since such sheets are designed to separate at the point of minimal overlap with relatively low separation forces, positive control and support of the sheets is necessary to minimize shear forces between adjacent sheets during folding and stacking. Positive control and support is particularly desirable in a high-speed, commercially viable production process.

Accordingly, it would be desirable to provide an improved method for preparing discrete sheets and forming them into a stack of folded interleaved sheets.

Additionally, it would be desirable to provide an improved method for preparing discrete sheets and forming them into a stack of folded interleaved sheets where the end edges of adjacent sheets are at least partially non-parallel such that they form an overlapping region having a non-uniform width.

Further, it would be desirable to provide an improved apparatus for forming a stack of folded interleaved sheets from a substantially continuous shingled web of partially overlapping discrete sheets.

SUMMARY OF THE INVENTION

The present invention relates to an improved method and apparatus for forming discrete sheets into an interleaved block of sheets suitable for use in a pop-up dispensing system. A preferred method comprises the steps of cutting a first web into a plurality of first discrete sheet members, and cutting a second web into a plurality of second discrete sheet members, the second discrete sheet members preferably being mirror images of the first discrete sheet members. The first and second discrete sheet members are then associated in alternating relationship such that they form a substantially planar continuous shingled web. The shingled web is then partially folded by urging the web out of a substantially planar configuration into a plurality of continuously supported accordion-like folds. Finally, the partially folded web is fully folded into an interleaved stack of discrete sheet members by collapsing the accordion-like folds.

The present invention also comprises an apparatus for forming a block of interleaved, partially overlapping discrete sheets suitable for a pop-up dispenser. The preferred apparatus comprises a first cutter for cutting a plurality of first discrete sheets and a second cutter for cutting a plurality of second discrete sheets, each second discrete sheet being a mirror image of each first discrete sheet. The first and second sheets are deposited upon a rotating vacuum transfer drum having an air permeable surface, which transfers the sheets to a vacuum conveyor in operative relationship with the vacuum transfer drum. The vacuum conveyor moves at a linear velocity less than the tangential velocity of the transfer drum, such that the first and second discrete sheets are transferred from the transfer drum to the vacuum conveyor in a shingled web relationship. A rotating folding wheel is positioned in operative relationship to receive the shingled web from the vacuum conveyor such that as the vacuum conveyor moves the shingled web linearly, the shingled web is continuously removed from the conveyor and partially folded by the rotating folding wheel. An accumulator platform is in operative relationship with the rotating folding wheel, such that the accumulator platform removes the discrete sheets from the folding wheel in a folded and stacked block of interleaved, partially overlapping sheets.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

The benefits and advantages of the present invention may be realized in cutting, folding, and stacking virtually any size or shape of wet or dry discrete sheets. However, the advantages are most notable when used to cut, fold, and stack sheets having non-uniform overlapping regions into interleaved, Z-folded stacks of discrete sheets suitable for use in pop-up dispensers.

The method of the invention, preferably carried out by the apparatus of the invention, generally comprises the steps of cutting discrete sheets, associating the discrete sheets in proper relationship, partially folding the sheets, and stacking the sheets while completing the folding process. The apparatus of the invention provides for positive control and support of the sheets during each processing step, such that minimal shear forces are produced between adjacent sheets. Support of the sheets throughout the process ensures that each sheet remains substantially flat until partially folded. Once partially folded, the folds preferably occur only at predetermined fold lines, with the remainder of the sheet remaining substantially planar. Support and positive control of each sheet is maintained until final folding and stacking, so that at no time during the process are individual sheets uncontrolled or unsupported.

Positive control and support of the sheets may be maintained by methods known in the art, such as by adhesive strips, mechanical grips, or even manual human interaction. Commercially viable production rates are achieved, however, by the use of the present invention, a preferred embodiment of which is disclosed.

The Sheets

Figure 1:
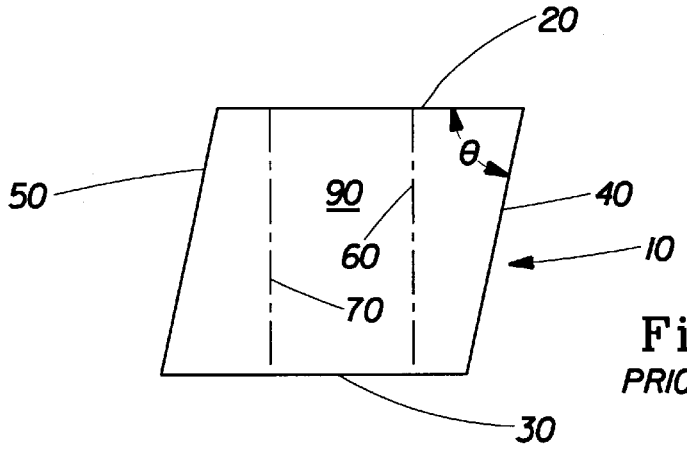
Fig. 1 PRIOR ART
FIG. 1 is a plan view of a prior art individual towel sheet having a generally parallelogrammatic configuration.
Figure 2:
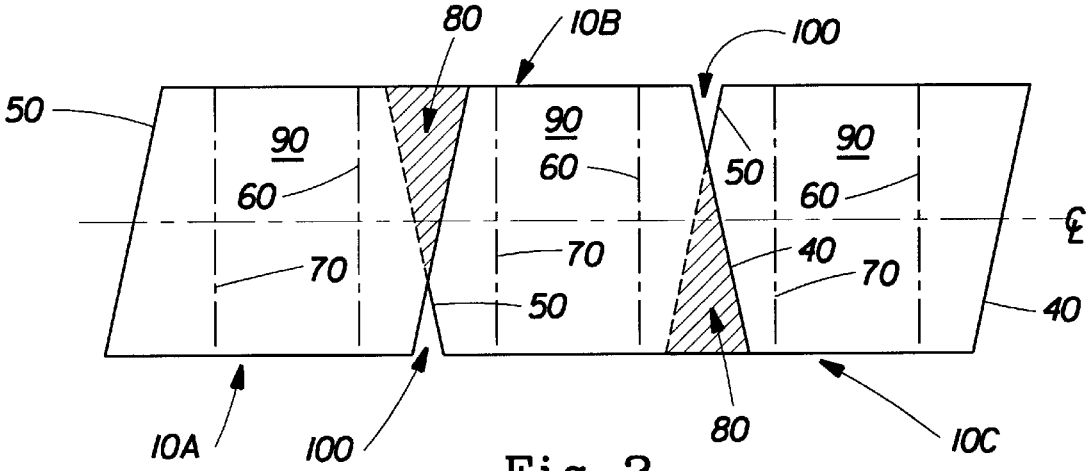
Fig. 2 PRIOR ART
FIG. 2 is a plan view of three prior art individual towel sheets, depicting their overlapping relationship prior to folding.
Figure 3:
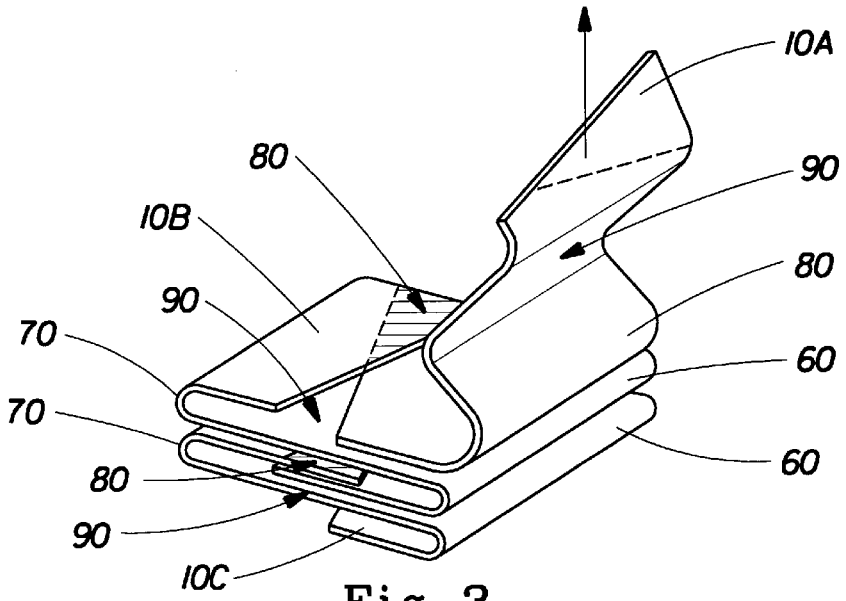
Fig. 3 PRIOR ART
FIG. 3 is a perspective view of the three separate towel sheets depicted in FIG. 2 which have been Z-folded and interleaved according to the present invention.

The present invention is useful in cutting, folding and stacking virtually any size or shape of sheet, but it is particularly useful for processing asymmetrical sheets, such as are depicted in FIGS. 1–3. For example, FIG. 1 shows an individual towel sheet 10 in its flat-out, unfolded state. The sheet has two side edges, 20 and 30, two end edges, 40 and 50, and preferably has two fold lines, represented by the dotted lines 60 and 70, for use in a Z-folded, interleaved configuration. The two side edges define the extent of the towel sheet in the transverse direction, while the two end edges define the extent of the towel in the longitudinal direction. The two fold lines define a center region 90 in a Z-folded configuration. The towel sheet 10 preferably has a generally parallelogrammatic overall shape with parallel, linear edges, and with the fold lines 60 and 70 essentially perpendicular to the side edges 20 and 30.

FIG. 1 also depicts the non-perpendicular relationship of the end edges 40 and 50 to the side edges 20 and 30. The angle θ (Theta) depicted in FIG. 1 represents the angle the end edge 40 makes with respect to the side edge 20, in this case some angle less than 90° (an acute angle). The angle made by the other end of end edge 40 with respect to side edge 30 would be the complementary angle of θ (i.e., 180-θ).

FIG. 2 depicts three individual towel sheets 10A, 10B, and 10C (such as towel 10 depicted in FIG. 1) which have been associated with one another to form a shingled web such that they define co-extensive or overlapping regions 80 (depicted by hatched areas) which extend from one side edge toward the other side edge. The centerline of the associated sheets is indicated by the dashed line CL, which is generally parallel to the longitudinal direction of the sheets forming a longitudinal direction for the web. The shingled web also has a transverse direction which, like the individual sheets, is generally orthogonal to the longitudinal direction.

Sheets 10A, 10B, and 10C may be three towels in an essentially continuous shingled web of sheets. Note that each sheet in a continuous shingled web partially overlaps an adjacent sheet and is partially overlapped by an adjacent sheet. This overlapping is referred to herein as "shingling"

and the sheets are herein referred to as being in a "shingled" relationship. Note also that although each sheet may be substantially identical in shape, the orientation of sheets alternates with every other sheet. This alternation is referred to herein as an A-B-A-B configuration, with the letters referring to the orientation of adjacent sheets. Therefore, as described below, "A" sheets are cut and oriented one way, while "B" sheets are cut and oriented in reverse orientation prior to being positioned in shingled relationship. In FIG. 2, for example, sheets 10A and 10C have like orientations and may be "A" sheets. Likewise, sheet 10B, having a reverse orientation, may be a "B" sheet.

As shown in FIG. 2, the overlapping end edges of adjacent sheets are substantially non-parallel, resulting in overlapping regions 80 having a width measured in the longitudinal direction which varies as a function of distance, in this instance linearly, across the sheet in the transverse direction from one side edge toward the other. In a preferred embodiment, this overlapping area is essentially triangular in shape, with at least one point of least overlap and at least one point of greatest overlap measured in the longitudinal direction. In an instance such as depicted in FIG. 2, wherein the extent of sheet overlap and the angles of the end edges are such that the overlapping regions do not extend entirely from one side edge to the other, a region identified with the numeral 100 is formed. Region 100 corresponds to a non-overlapping area, or what may be referred to as an "underlapping" area. The overlapping region 80 is essentially triangular in shape in this preferred embodiment.

When folded by the method of the present invention, the individual towel sheets are interfolded along their fold lines 60 and 70 as shown in FIG. 3 so as to capture the end edge of one sheet between the end edge and center region of the adjacent sheet. Viewing the interfolded stack of sheets from the perspective of FIG. 3, the alternating sequence of overlapping regions 80 and center 90 is clearly visible, with the trailing edge of an upper sheet of an interleaved pair of sheets always captured beneath the leading edge of the next lower sheet. In this manner, an upward pulling force exerted on the upper sheet automatically ensures that the leading edge of the next sheet will be pulled upward from the remaining stack of sheets rather than remaining adhered to the stack.

The towel sheets themselves may be formed of any commonly-used tissue-type paper; material, or any other similar thin and flexible sheet-like material deemed suitable for use in such a pop-up dispensing system. The basis weight, composition, and texture of the towel sheets may be tailored so as to achieve the desired durability, feel, and cleansing ability. The overall dimensions of the towel sheets can be selected as appropriate to accomplish the intended tasks. Single-ply towels sheets of cellulose-based material having basis weights in the range between about 0.0043 $g/cm^2$ (0.0087 $lb/ft^2$) and about 0.0078 $g/cm^2$ (0.0138 $lb/ft^2$) have been used successfully, and overall sheet dimensions of approximately 8 inches in the longitudinal direction and approximately 7 inches in the transverse direction have performed satisfactorily.

Sheet Cutting

Sheet cutting may be accomplished by various methods known in the art, including by hand. However, a preferred method of cutting is by use of cut and slip assemblies 120 and 130, shown as part of a preferred apparatus 150 of the present invention, represented schematically in FIG. 4. Cut and slip assemblies 120 and 130 each comprise two counter-rotating rollers that operate to cut sheets and place them in regularly spaced alternating fashion upon vacuum drum 160. Cut and slip assemblies 120 or 130 may operate continuously or intermittently, depending on the desired placement upon, and rotational speed of, vacuum drum 160. Both rollers of each cut and slip assembly preferably have vacuum capability for added web control. Additionally, at least one roller of each, e.g., rollers 121 and 131 have positive pressure capability in portions of the roller such that the web material may be held to the roller upon cutting, and subsequently transferred to vacuum drum 160 by a "blast" of pressurized air for prompt, accurate transfer and placement from rollers 121 or 131 to vacuum drum 160.

Prior to cutting, two webs of sheet material, 200 and 300 are provided, preferably from substantially continuous sources of roll stock. Each web has a transverse direction defining a width and a longitudinal direction defining a length. Midway between the sides of the web is a longitudinal web centerline, corresponding to the sheet centerline depicted in FIG. 2. Two webs are preferable due to the alternating sheet configuration depicted in FIG. 2. Although it is possible to cut asymmetrical sheets from a single web, and invert or "flip" certain sheets to achieve an alternating pattern, the use of two webs avoids complicated inverting operations and allows higher speed operation.

Webs 200 and 300 are guided into cut and slip assemblies 120 and 130, respectively, where they are die cut by cutters 122 and 133 on a predetermined angle θ, and preferably scored by scoring blades 125 and 135 at fold lines 60 and 70, as shown in FIG. 1. The die cuts are preferably linear, and each end edge is preferably cut at identical angles θ, thereby producing parallelogram-shaped towel sheets with each rotation of the rotary cutters. Parallelogram-shaped sheets eliminate scrap at the cutting operation, and simplify the step of associating the sheets as described below. In a preferred embodiment, scoring blades produce a line of weakness at the fold lines such that the sheets are predisposed to fold along the line of scoring.

Web 200 is cut in an "A" configuration, while web 300 is cut in a "B" configuration. "A" and "B" refer to the orientation of the angle-cut portions of the die-cut sheets 210 and 310, respectively. The "A" and "B" oriented sheets are preferably mirror images of each other, arranged in such a manner as to ensure that each of the sheets of the shingled web (described below) partially overlaps an adjacent sheet and is partially overlapped by an adjacent sheet as shown in FIG. 2. In FIG. 2, for example, sheets 10A and 10C may be "A" sheets, while sheet 10B may be a "B" sheet. As described more fully below, once associated according to the present invention, sheets alternate in A-B-A-B fashion to form a continuous shingled web of partially overlapped sheets in a shingled configuration.

Associating Adjacent Sheets

After cutting and scoring, the individual sheets 210 and 310 are positioned in line in alternating A-B-A-B spaced relationship upon rotating vacuum transfer drum 160. Sheets are deposited onto the drum as they are cut, preferably by being fed onto the drum from cut and slip assemblies 120 and 130 with the respective centerline of each sheet being substantially collinear with each adjacent sheet. Vacuum is provided via drum perforations by a stationary internal vacuum manifold 161, which provides vacuum throughout a portion of the rotating drum circumference. As the leading edge of sheets 210 or 310 contacts the drum, it is secured by vacuum and directed in the direction of the surface of vacuum drum 160. Once the trailing edges of the sheets are cut, each discrete sheet is positively controlled and supported by vacuum transfer drum 160. In a preferred embodiment vacuum transfer drum 160 rotates with a tangential linear velocity at least two times that of the linear velocity of incoming webs 200 and 300 to ensure a preferred spacing of the cut sheets on transfer drum 160.

Figure 4:
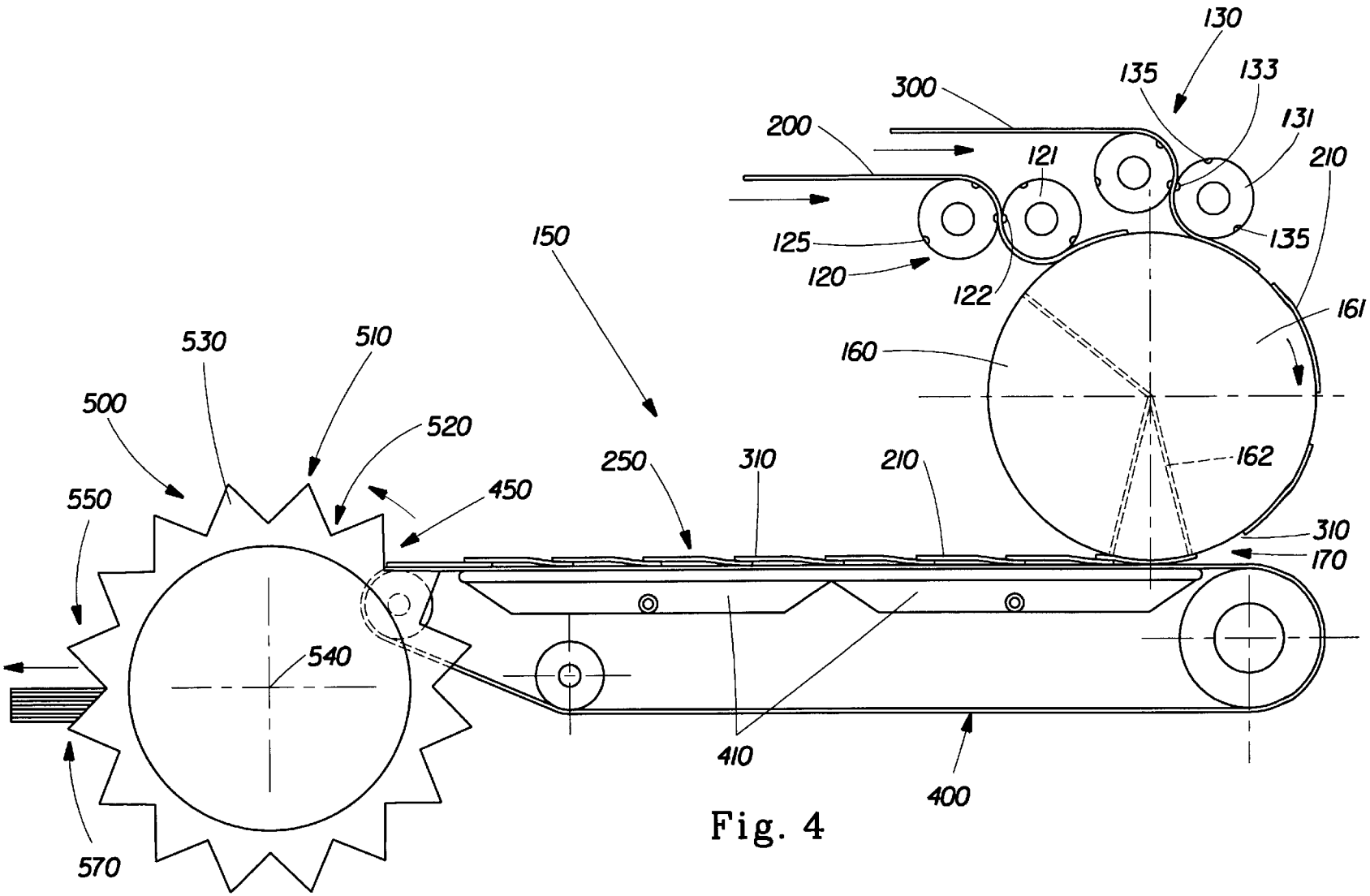
FIG. 4 is a schematic representation of an apparatus of the present invention useful for forming Z-folded interleaved stacks of sheets having a generally parallelogrammatic configuration.

Final association of individual sheets 210 and 310 in preparation of folding is accomplished as they are deposited from transfer drum 160 onto shingling conveyor 400 at vacuum drum transfer region 170. FIG. 4 depicts a preferred configuration of the vacuum transfer drum 160 and the shingling conveyor 400, with the vacuum transfer drum 160 positioned above shingling conveyor 400, and with the vacuum drum transfer region 170 including the area of closest proximity between the vacuum transfer drum 160 and the shingling conveyor 400.

As sheets 210 and 310 are rotated on transfer drum 160 into transfer region 170, they are transferred by being deposited in an ordered A-B-A-B shingled relationship onto shingling conveyor 400. Each sheet centerline is substantially collinear with the centerline of each adjacent sheet, such that the centerlines of the sheets form a longitudinal centerline of the shingled web. Sheets 210 and 310 can be deposited onto shingling conveyor 400 by gravity, but in a preferred embodiment, a pressure manifold 162 may be used at transfer region 170 to provide positive pressure via the drum perforations to release sheets 210 and 310 from transfer drum and force them towards shingling conveyor 400. The positive air pressure "air blast" acts to quickly blow the sheets off the transfer drum, accurately placing the sheets in an ordered, shingled relationship on shingling conveyor 400. Vacuum manifolds 410 provide vacuum to shingling conveyor 400 to further assist in the precise transfer and placement of sheets 210 and 310 into a continuous shingled web 250.

As used herein with reference to the shingled web, "continuous" refers to the uninterrupted character of adjacent overlapping discrete sheets, and is not meant to infer any specific length of the shingled web itself In a preferred embodiment, however, the shingled web should be at least long enough to produce a complete stack of Z-folded wipes. For example, to produce an 20-count stack of wipes, the shingled web would require 20 discrete sheets in an uninterrupted, continuous shingled web. Commercially viable processes may require much longer continuous webs. The length of the shingled web by the method of the present invention, when carried out by the apparatus of the present invention is limited only by the length of webs 200 and 300.

To ensure that transfer drum 160 deposits the cut sheets in a shingled configuration, shingling conveyor 400 runs at a slower velocity than the tangential velocity of vacuum transfer drum 160. The relative speed of the transfer drum to the shingling conveyor determines the amount of overlap of adjacent sheets on the shingling conveyor. The amount of overlap is preferably sufficient to ensure that the distance between fold lines of adjacent sheets is equal to the distance between fold lines on each sheet. Having equi-distant fold lines aids in proper folding by means of a folding wheel, as described in detail below.

There is a predetermined amount of clearance between vacuum transfer drum 160 and shingling conveyor 400, so that as individual sheets 210 and 310 enter vacuum drum transfer region 170, the sheets on vacuum transfer drum 160 clear the sheets previously deposited onto shingling conveyor vacuum may be released from vacuum transfer drum 160, and sheets 210 and 310 can be deposited onto shingling conveyor 400. The predetermined amount of clearance is determined by the sheet thickness of the individual sheets, and for typical tissues or wipes, this distance may be approximately 3–6 mm (⅛–¼ inch).

Partial Folding

Once the cut sheets are formed in an alternating, shingled relationship as part of a continuous shingled web, the folding operation may be started. Since relatively low shear forces between overlapping adjacent sheets may cause the sheets to pull apart, positive control and support is important during the folding process. Positive control and support may be accomplished by using a multi-step folding process, whereby folding is started by first urging the shingled web out of a flat plane into a partially folded, fully supported configuration with transverse folds occurring along fold lines 60 and 70. By "partially folded" is meant that if viewed edge-on, orthogonal to the longitudinal centerline, shingled web 250 would appear zigzagged, or somewhat accordion-like.

Multi-step folding by first partially folding is preferably accomplished by the method of the present invention as a two-step process, the first step being partial folding by use of an out-of-plane folder, preferably a rotating folding wheel. A folding wheel allows continuous processing of the shingled web from the shingling conveyor to the stacking and final folding step as described more fully below. In a preferred embodiment, sheets 210 and 310 are conveyed as part of continuous shingled web 250 on shingling conveyor 400 to a folding wheel, preferably a star-shaped folding wheel such as star-shaped folding wheel 500. A star-shaped folding wheel provides a support surface for urging the shingled web out of a generally planar configuration and into a partially folded configuration.

The star-shaped folding wheel may be constructed out of any of various known structural building materials, such as wood, metal, or plastic. A preferred star-shaped folding wheel includes a plurality of "star" shaped members consisting of points 510 and pockets 520. For example, FIG. 4 shows a star-shaped panel having 16 points 510 and pockets 520. Star-shaped folding wheel 500 rotates about axis 540 at a sufficient rate to ensure controlled transfer of shingled web 250 from shingling conveyor 400 onto star-shaped folding wheel 500 at star-shaped folding wheel transfer region 450. Control of the discrete sheets upon the star-shaped folding wheel may be accomplished by various ways known in the art, such as by releasable adhesive or mechanical entrapment. However, control is preferably attained by use of vacuum, for example, via a plurality of air-permeable face portions of vacuum flights 530 which form the perimeter of the star-shaped folding wheel.

Figure 5:
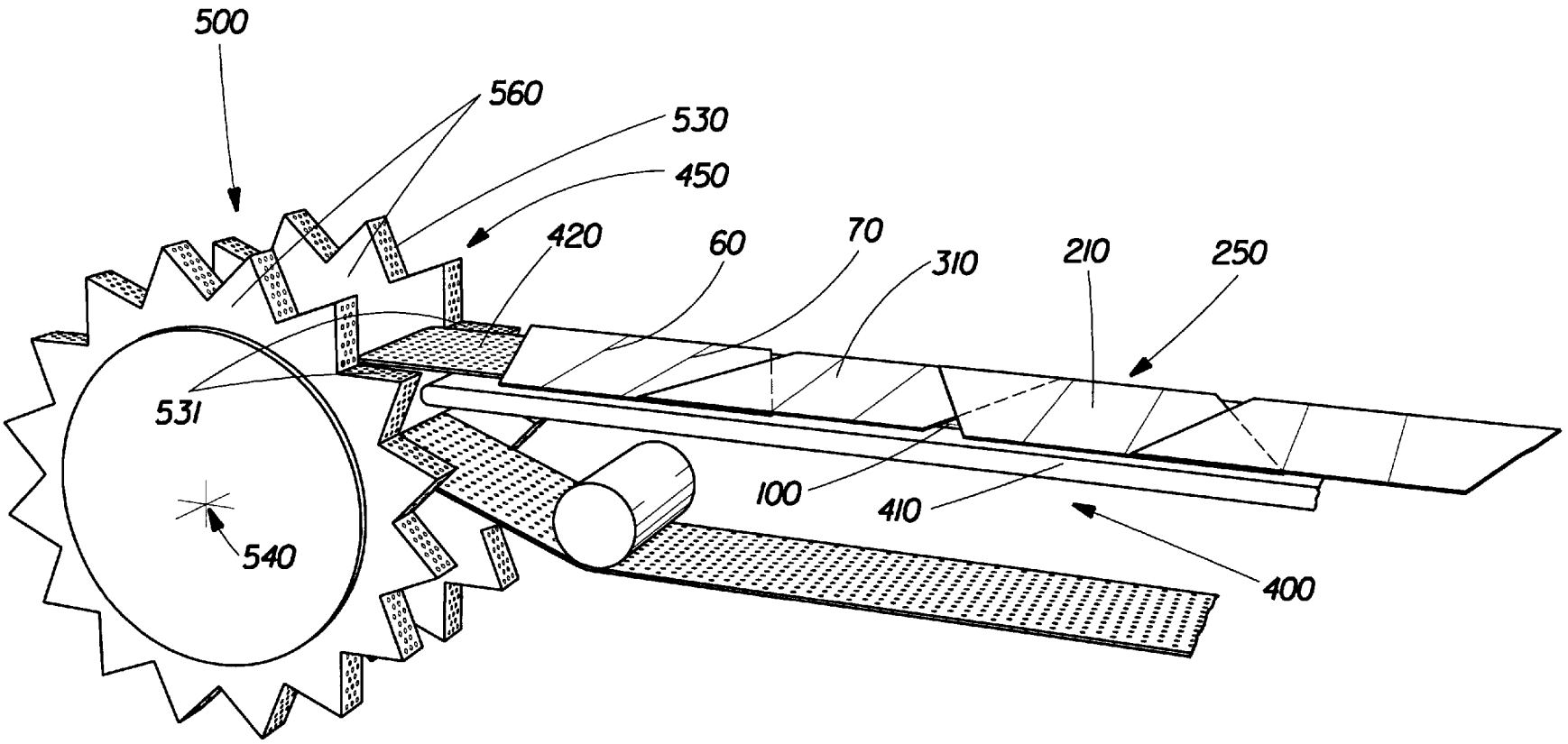
FIG. 5 is a perspective view of a star-shaped folding wheel folder of the present invention, showing the area at which sheet folding begins.
Figure 6:
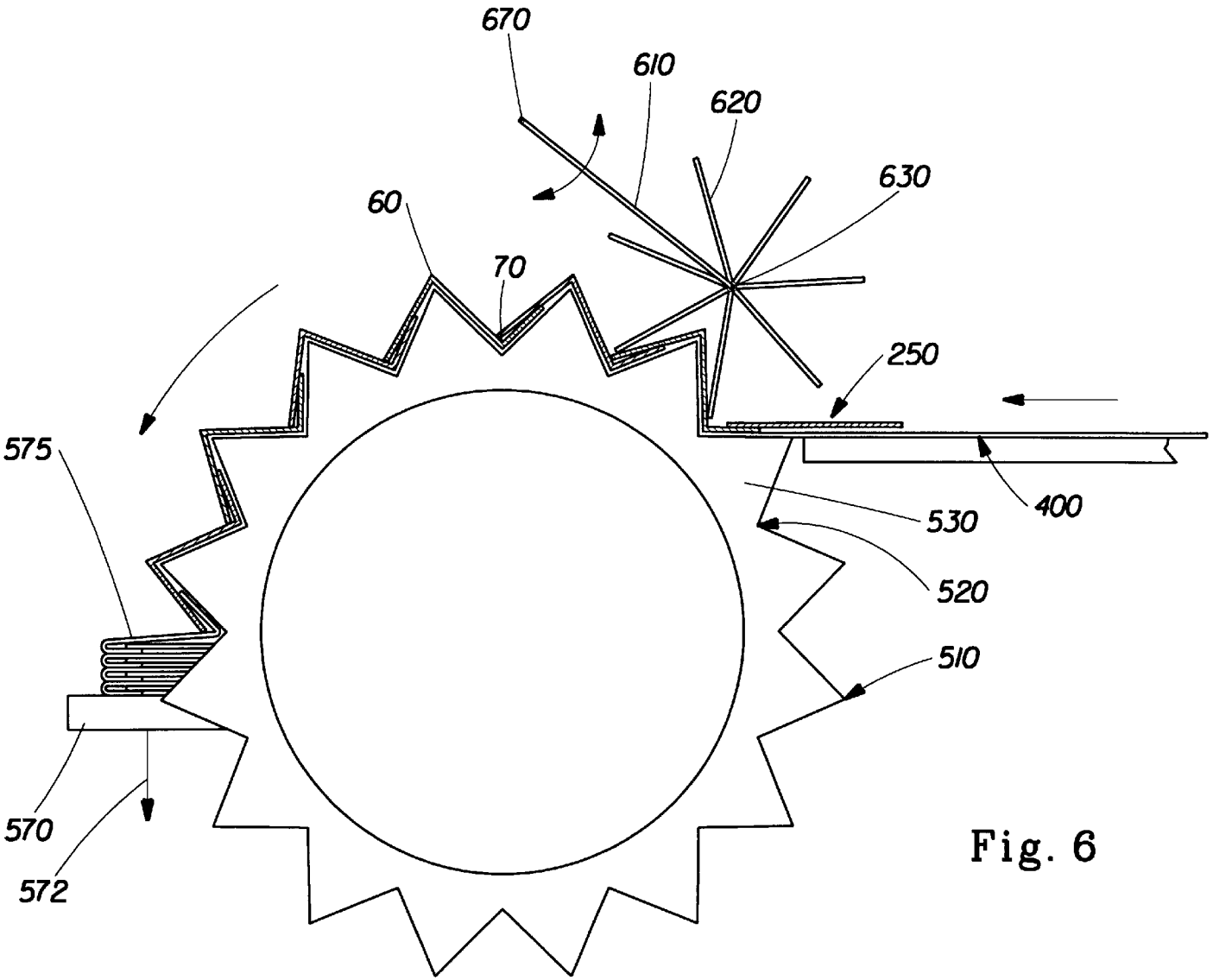
FIG. 6 is a simplified side view of a star-shaped folding wheel folder of the present invention, showing the general sequence of folding and depositing folded sheets into stacks, as well as a folding assist assembly.
Figure 7:
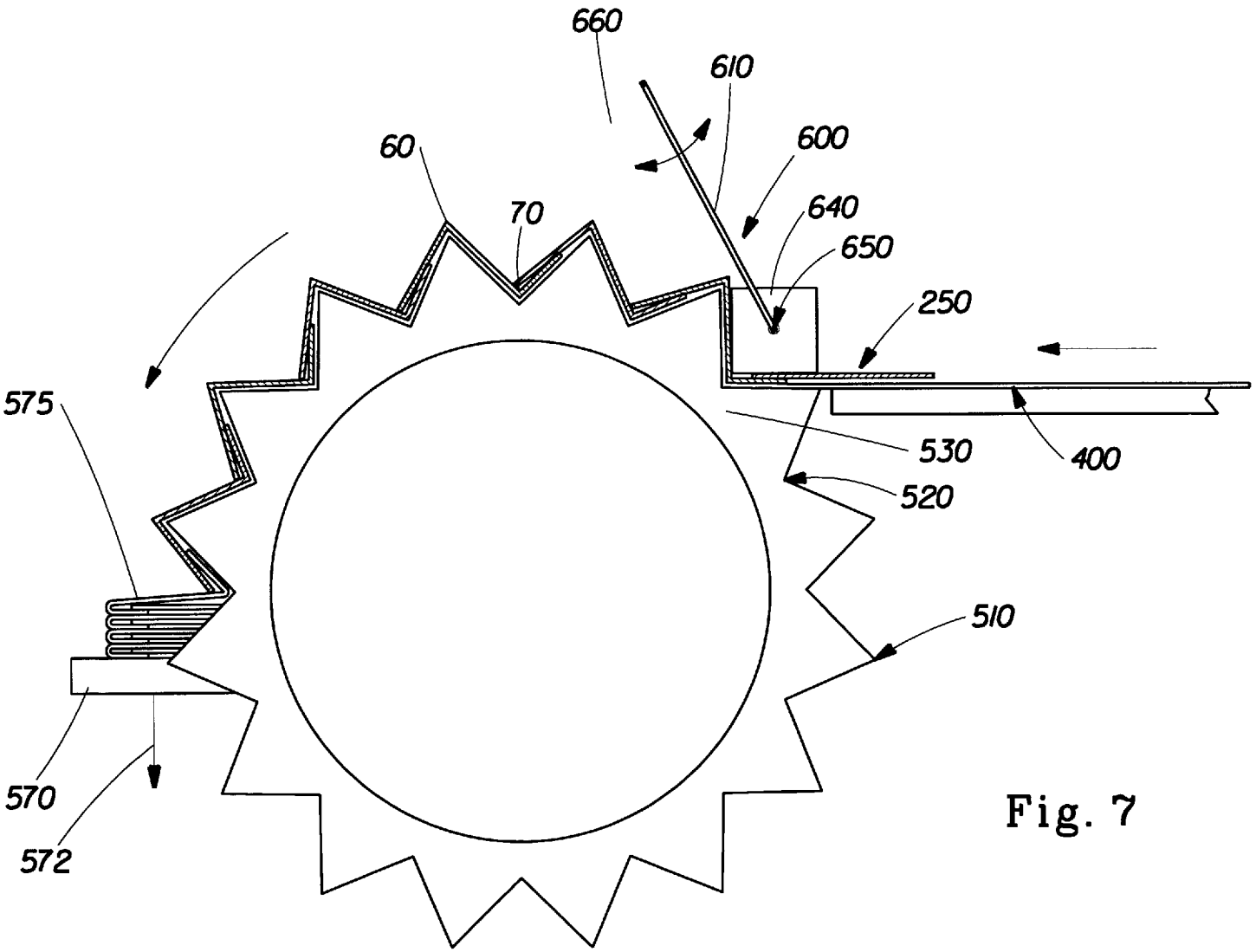
FIG. 7 is a simplified side view of a star-shaped folding wheel folder of the present invention, showing the general sequence of folding and depositing folded sheets into stacks, as well as an alternative folding assist assembly.

As shown in FIGS. 5, 6 and 7, star-shaped folding wheel 500 comprises generally parallel star-shaped panels 560, each star-shaped panel having a width defining an interior portion, at least a portion the interior portion being at a partial pressure, i.e., under vacuum. Star-shaped panels 560 may be attached about the perimeter of a common hub, sharing a common vacuum source. Alternatively, each may be separately mounted upon a common axis, each having its own vacuum source, and each being driven in coordinated rotation with the other. In either configuration, star-shaped folding wheel 500 is designed to accommodate the end of the shingling conveyor 400 between star-shaped panels 560, so that control and support of the shingled web passes without significant interruption from shingling conveyor 400 to star-shaped folding wheel 500.

The preferred star-shaped folding wheel as depicted has two star-shaped panels, but the method and apparatus of the present invention is not to be limited to only two star-shaped panels. It is contemplated that beneficial results may be obtained with one, three, or more star-shaped panels, along with necessary modifications to related components. For example, for very small sheets such as pocket tissues, a single star-wheel may be used, with the shingling conveyor having a split end portion at transfer region 450 and the star-wheel disposed between the split end portion of the shingling conveyor. For very large sheets, three or more star-wheels may be necessary to provide adequate support and control during folding.

Although a round star-shaped folding wheel is a preferred embodiment of an out-of-plane folder, non-round variations of the star-shaped folding wheel concept are contemplated. For example, the star-shaped folding wheel concept could be incorporated into an endless belt configuration. The "wheel" could be a flexible belt, essentially a conveyor belt, with the points and pockets of the "star" flexibly attached to the belt. In operation the conveyor belt would operate generally identically to the star-shaped folding wheel, with minor design variations incorporated as required.

In operation, shingling conveyor 400 transports shingled web 250 toward and in between star-shaped panels 560 of star-shaped folding wheel 500, as shown in FIG. 4. A portion of shingling conveyor including a perforated vacuum belt 420 extends partially into the space between star-shaped panels 560. Positive control of sheets 210 and 310 transfers to star-shaped folding wheel 500 at star-shaped folding wheel transfer region 450 by initiating vacuum in vacuum flights, for example flights 531, while simultaneously releasing vacuum on vacuum belt 420 in star-shaped folding wheel transfer region 450. The region of perforated vacuum belt 420 which extends between star-shaped panels 560 is preferably supplied with a separate vacuum manifold to enable release of vacuum at the time of transfer. Additionally, this portion of the vacuum belt may include a positive pressure manifold to enable a short "air blast" to aid in the transfer of the sheet to the star-shaped folding wheel 500.

As shown in FIG. 6, shingling conveyor 400 and star-shaped folding wheel 500 are synchronized such that as star-shaped folding wheel 500 rotates into a position where one pair of vacuum flights, for example flights 531, is substantially planar with shingling conveyor 400, sheet 210 or 310 is positioned for transfer and folding. The length of each air permeable face portion 530 corresponds to the distance between fold lines on sheets 210 and 310. Proper positioning is accomplished when sheet 210 or 310 folds at fold line 60 over points 510 as star-shaped folding wheel 500 continues to rotate, lifting sheet 210 or 310 off of shingling conveyor 400. As star-shaped folding wheel 500 rotates fold line 70 preferably folds in pocket 520 as fold line 60 folds over point 510.

To ensure proper placement of fold lines 70 in relationship to star-wheel pockets 520, a folding assist assembly 600 may be used, as shown in FIGS. 6 and 7. In a preferred embodiment, folding assist assembly 600 comprises a plurality of blades 620, as shown in FIG. 6. The blades may be made of any relatively stiff, flat material, such as aluminum, wood, plastic, or other suitable metal. Blades 620 emanate radially from a common point of rotation 630, and are generally as wide as the star-wheel 500. Blades 620 are mounted on swing arm 610 which is pivotally attached about point 670. Swing arm 610 may be spring loaded to ensure proper operation, particularly at high speed rotation of the star-shaped folding wheel 500. Folding assist assembly 600 rotates freely with star-shaped folding wheel 500 as blades 620 sequentially urge sheets 210 or 310 into proper position in pockets 520.

FIG. 7 depicts an alternative folding assist assembly 600 comprising a block 640 of square cross section which is generally as wide as star-shaped folding wheel 500. Block 640 may be made of wood, metal, plastic, or other material suitable for use with the particular physical characteristics of the partially folded sheets. Block 640 is rotatably attached to swing arm 610 which is in turn pivotally attached at point 660. When in the position shown in FIG. 7, block 640 serves to assist in conforming the shingled web of sheets to the star-shaped folding wheel. As star-shaped folding wheel 500 rotates, block 640 is urged toward, and rotates over, the adjacent point 510, sequentially conforming the shingled web of sheets to the star-shaped folding wheel. Block 640 may slide forward and rotate over point 510, or alternatively, block 640 may simple rotate about the corner adjacent point 510 into place adjacent the next sequential pocket and point of the star-shaped folding wheel. Swing arm 610 may be spring loaded as necessary to ensure proper operation of folding assist assembly 600.

Final Folding and Stacking

Figure 8:
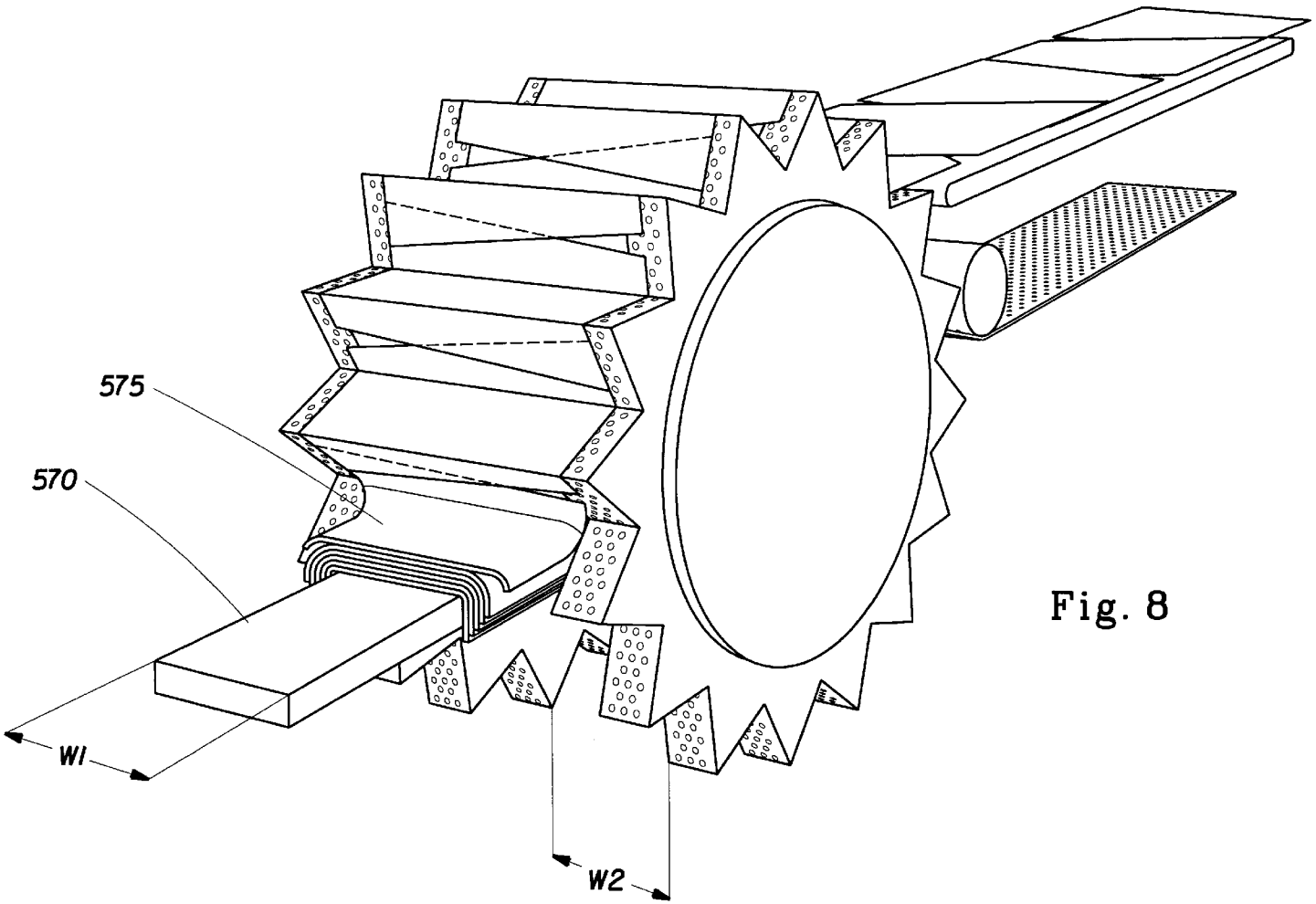
FIG. 8 is a perspective view of a star-shaped folding wheel folder of the present invention, showing partially folded sheets being deposited in a Z-folded, interleaved stack.

Once shingled web 250 is urged out of a planar configuration and partially folded, folding may be completed by urging the partially folded shingled web into a fully folded stack. This is preferably accomplished by impeding the motion of the partially folded web upon the star-wheel such that the accordion-like folds collapse upon themselves into a fully folded, interleaved stack. A preferred method for impeding the motion of the partially folded web is by use of an accumulator platform. As shown in FIGS. 6, 7, and 8, as star-shaped folding wheel 500 rotates, sheets 210 and 310 are deposited in an interleaved, Z-folded stack, or block, 575 onto accumulator platform 570. Accumulator platform 570 is substantially stationary relative to star-shaped folding wheel 500 and is positioned for partial placement between star-shaped folding wheel panels 560. As star-shaped folding wheel 500 rotates, accumulator platform 570 physically prevents sheets 210 and 310 from continuing along the path of the star-shaped folding wheel.

Vacuum is released from vacuum flights 530 immediately prior to stacking on accumulator platform 570 such that sheets 210 and 310 are deposited in an interleaved, stacked manner. The accumulator platform is not completely stationary, however. As sheets 210 and 310 are stacked onto accumulator, accumulator 570 is lowered in the direction of arrow 572 so that the top of stack 575 remains in substantially constant relationship to star-shaped folding wheel 500.

As depicted in FIG. 8, the width W1 of the accumulator platform 570 is determined by the inside distance W2 between star-shaped folding wheel panels 560. Because sheets 210 and 310 are wider in the transverse direction than the inside distance between star-shaped folding wheel panels 560, there is preferably sufficient space between each side of the accumulator platform and the inside of the star-shaped folding wheel panels to allow for some bending of the edges of sheets 210 and 310 after being deposited onto accumulator platform 570. Therefore, as sheets are removed from star-shaped folding wheel 500, sheets may be bent down at their edges as the inside of star-shaped folding wheel panels 560 brush by until clear of stack 575.

Once a predetermined number of sheets have been fully folded and stacked, accumulator 570 may be removed and replaced by another accumulator, and the process of stacking is repeated. The removal of one accumulator and replacement with another may be done in a continuous manner, without a break in the continuous shingled web, however, a preferred method of accomplishing the removal of an accumulator having the required number of stacked sheets is to provide a gap in the continuous shingled web being folded upon the star-wheel folder. For example, cut and slip assemblies 120 and 130 could be stopped at predetermined intervals to leave a sufficient gap between continuous shingled webs on shingling conveyor 400. By this method each continuous shingled web would preferably comprise the number of discrete sheets desired in the finished stack of folded sheets. Once a continuous shingled web is processed completely by final folding and stacking upon an accumulator 570, that accumulator and stack may be removed and replaced by another accumulator during the interval between continuous shingled webs. The final folding and stacking of the next continuous shingled web would then begin upon the new accumulator, with the process being repeated for each continuous web.

Alternatively, clearance between accumulator platform 570 and the inside of star-shaped folding wheel panels 560 may be provided for by positioning star-shaped folding wheel panels 560 in a non-parallel relationship. In this embodiment, inside distance W2 between star-shaped folding wheel panels 560 would be variable, with the greatest width occurring in the region of accumulator platform 570, and the narrowest width at transfer region 450. Other alternatives for facilitating transfer to folded sheets onto accumulator platform 570 are contemplated, including having moveable flights 531 that fold out of the way to provide clearance after depositing the folded sheets onto the stack at the accumulator platform 570.

Folding and stacking of discrete sheets continues essentially without interruption in a repetitive process of producing stacks of interleaved Z-folded discrete sheets. The process cycle continues as long as a continuous shingled web is provided to the star-shaped folding wheel. Modified Z-folds are possible by making the individual sheets longer in the longitudinal direction. In a modified Z-fold, each sheet may have more than two fold lines, the number of folds limited only by the number of points in the star-shaped folding wheel between the shingling conveyor and the accumulator platform.

The method and apparatus of the present invention is particularly useful in folding and stacking interleaved sheets where the end edges of adjacent sheets are at least partially non-parallel such that they form an overlapping region having a non-uniform width. By providing support and positive control throughout the process, the method and apparatus of the present invention overcomes difficulties in processing such sheets, including the problem of unwanted sheet separation due to minimal shear forces between adjacent sheets.

While particular embodiments of the present invention have been illustrated and described, it would be obvious to those skilled in the art that various other changes and modifications can be made without departing from the spirit and scope of the present invention. The foregoing is therefore intended to cover in the appended claims all such changes and modifications that are within the scope of the present invention.

What is claimed is:

1. An apparatus for forming a stack of interleaved, partially overlapping discrete sheets suitable for a pop-up dispenser, said apparatus comprising:

(a) a first cutter for cutting a plurality of first discrete sheets;

(b) a second cutter for cutting a plurality of second discrete sheets, each said second discrete sheet being a mirror image of each said first discrete sheet;

(c) a rotating vacuum transfer drum having an air permeable surface, said transfer drum rotating with a tangential velocity in operative relationship with said first and second cutters such that said first and second discrete sheets are deposited upon said vacuum transfer drum in an alternating spaced relationship after cutting;

(d) a vacuum conveyor in operative relationship to receive said first and second discrete sheets from said vacuum transfer drum, said vacuum conveyor moving at a linear velocity less than said tangential velocity of said transfer drum, such that said first and second discrete sheets are transferred from said transfer drum to said vacuum conveyor in a shingled web relationship;

(e) an out-of-plane folder in operative relationship to receive said shingled web from said vacuum conveyor such that as said vacuum conveyor moves said shingled web linearly, said shingled web is continuously removed from said conveyor and partially folded by said out-of-plane folder; and (f) an accumulator platform in operative relationship with said out-of-plane folder, said accumulator platform removing said discrete sheets in a folded and stacked block of interleaved, partially overlapping sheets.

2. The apparatus of claim 1, wherein said first and second cutters are rotating die cutters, such that continuous webs of material may be die cut into a plurality of discrete sheets in a continuous cutting operation.

3. The apparatus of claim 1, wherein said rotating vacuum transfer drum comprises at least one region of partial pressure vacuum and at least one region of positive pressure.

4. The apparatus of claim 1, wherein said out-of-plane folder comprises a folding wheel.

5. The apparatus of claim 4, wherein said folding wheel comprises a star-shaped folding wheel, said star-shaped folding wheel comprising at least one star-shaped panel.

6. The apparatus of claim 4, wherein said folding wheel comprises an axis of rotation, said folding wheel further comprising at least two star-shaped panels, said star-shaped panels being joined together in a spaced apart relationship along said axis of rotation; each of said star-shaped panels having a perimeter and an interior portion, each of said star-shaped panels also having an air permeable face portion.

7. The apparatus of claim 6, wherein said interior of said star-shaped panels is at a partial pressure such that a vacuum is created at said air permeable face portions.

8. The apparatus of claim 6, wherein said star-shaped panels are in a generally parallel relationship.

* * * * *